US007170456B2

(12) United States Patent
Kwak et al.

(10) Patent No.: US 7,170,456 B2
(45) Date of Patent: Jan. 30, 2007

(54) DIELECTRIC CHIP ANTENNA STRUCTURE

(75) Inventors: Won Il Kwak, Daejeon (KR); Seong Ook Park, Daejeon (KR)

(73) Assignee: Information and Communications University Research and Industrial Cooperation Group, Daejeon (KR)

( * ) Notice: Subject to any disclaimer, the term of this patent is extended or adjusted under 35 U.S.C. 154(b) by 0 days.

(21) Appl. No.: 11/194,703

(22) Filed: Aug. 2, 2005

(65) Prior Publication Data

US 2006/0192713 A1 Aug. 31, 2006

(30) Foreign Application Priority Data

Feb. 25, 2005 (KR) ..... 10-2005-0015740

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

| | | | | |
|---|---|---|---|---|
| 6,323,811 | B1 * | 11/2001 | Tsubaki et al. | 343/700 MS |
| 6,876,328 | B2 * | 4/2005 | Adachi et al. | 343/700 MS |
| 2002/0067312 | A1 * | 6/2002 | Hilgers | 343/700 MS |
| 2003/0063033 | A1 * | 4/2003 | Purr et al. | 343/700 MS |
| 2006/0170611 | A1 * | 8/2006 | Ko et al. | 343/895 |

* cited by examiner

*Primary Examiner*—Tan Ho
(74) *Attorney, Agent, or Firm*—Greenblum & Bernstein, P.L.C.

(57) ABSTRACT

Disclosed herein is a dielectric chip antenna structure using a metal conductor formed at the lateral side of the antenna along the longitudinal direction of the antenna. The dielectric chip antenna structure forms the metal conductor at the long side of the antenna to induce antenna resonance through coupling effect between the antenna and the ground. Furthermore, the dielectric chip antenna structure minimizes the space occupied by the antenna and modifies the theoretical feeding structures of the reverse F type antenna and monopole antenna to meet user's various demands.

15 Claims, 10 Drawing Sheets

DIELECTRIC CHIP ANTENNA STRUCTURE

BACKGROUND OF THE INVENTION

1. Field of the Invention

The present invention relates to a dielectric chip antenna structure suitable for miniaturization, and more particularly, to a dielectric chip antenna structure made smaller than a general built-in antenna for effectively reducing its resonance frequency and improving antenna efficiency.

2. Background of the Related Art

An antenna used for mobile communication services is a passive element whose characteristic sensitively varies with its surrounding environment. This antenna receives electric waves from an antenna attached to a base station, a repeater or a radio communication device or transmits an electric signal generated from a communication device to the outside. A typical model of this antenna is a monopole antenna having a length of approximately ¼ of the wavelength thereof.

Antennas of current mobile communication devices are evolving from external antennas toward built-in antennas. As a portable mobile terminal is miniaturized increasingly, the space occupied by an antenna in the terminal is also restricted and reduced.

A built-in antenna used for a mobile communication device does not fully use a metal conductor on a printed circuit board (PCB). Thus, the antenna requires a larger occupying space in the mobile communication device in terms of its characteristic even if the antenna is small. Furthermore, when two antennas having the same wavelength are formed on one PCB, phase interference between the antennas deteriorates antenna characteristics.

SUMMARY OF THE INVENTION

Accordingly, the present invention has been made in view of the above problems occurring in the prior art, and it an object of the present invention is to provide a dielectric chip antenna structure having various structures for improving antenna characteristic while minimizing the space occupied by the antenna in a device.

To accomplish the above object, according to the present invention, there is provided a dielectric chip antenna structure for efficiently inducing a resonance frequency through a gap between the longitudinal side of the antenna and the ground and improving a printed circuit board mounting technique.

The dielectric chip antenna structure includes: a printed circuit board on which an antenna is mounted, the printed circuit board having a feeding line formed in a predetermined pattern thereon for feeding and short-circuited top and bottom planes formed thereon; a first metal conductor formed on the top plane of the printed circuit board, for feeding; a second metal conductor for short-circuiting the first metal conductor and a feeding part of the antenna and fixing the antenna; a third metal conductor for short-circuiting a grounding part of the antenna and fixing the antenna; a fourth metal conductor formed at the longitudinal side of the antenna to induce antenna resonance characteristic through antenna coupling effect between the antenna and the ground; circular or semicircular via holes formed in the top and bottom planes in such a manner as to penetrate the top and bottom planes to short-circuit the top and bottom planes, the sidewalls of the via holes being coated with a metal; a fifth metal conductor for connecting the top and bottom planes when the via holes are eliminated; and sixth and seventh metal conductors respectively formed on the top and bottom planes for forming the fourth metal conductor and control an input impedance of the antenna.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
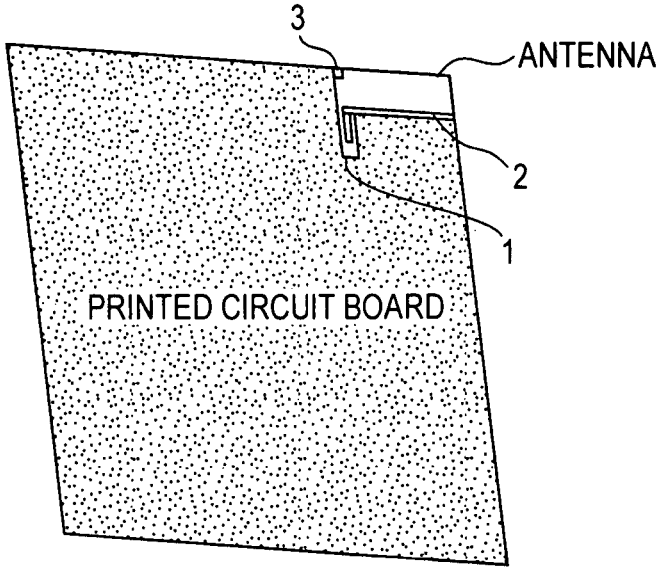
FIG. 1 illustrates the structure of a dielectric chip antenna structure according to a first embodiment of the present invention.
Figure 2:
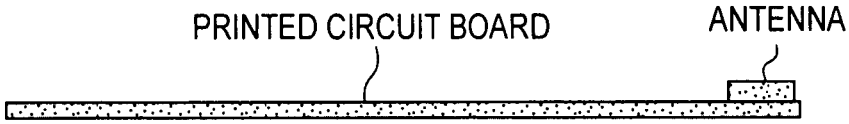
FIG. 2 is a side view of the dielectric chip antenna structure according to the first embodiment of the present invention.
Figure 3:
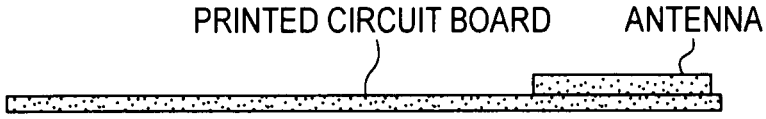
FIG. 3 is a front view of the dielectric chip antenna structure according to the first embodiment of the present invention.
Figure 4:
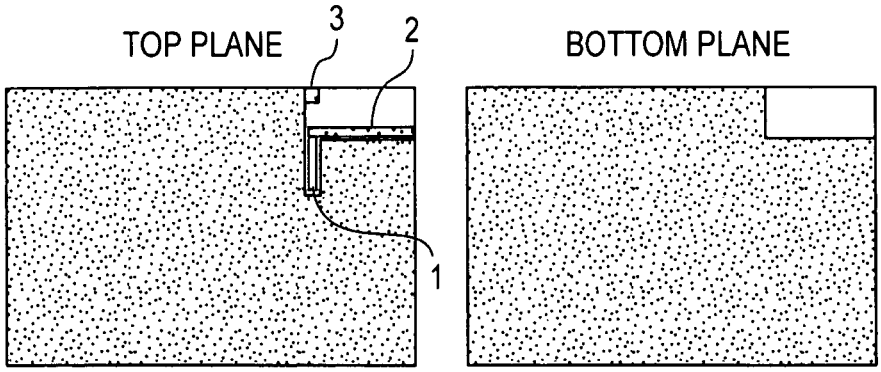
FIG. 4 illustrates the structure of the printed circuit board of FIG. 1.

A dielectric chip antenna structure according to a first embodiment of the present invention will now explained in detail with reference to FIGS. 1 through 6. FIG. 1 illustrates the structure of the dielectric chip antenna structure according to the first embodiment of the present invention, FIG. 2 is a side view of the dielectric chip antenna structure according to the first embodiment of the present invention, and FIG. 3 is a front view of the dielectric chip antenna structure according to the first embodiment of the present invention. FIG. 4 illustrates the structure of the printed circuit board of FIG. 1, and FIGS. 5 and 6 respectively illustrate top and bottom planes of the dielectric chip antenna structure according to the first embodiment of the present invention.

Referring to FIGS. 1 through 6, the dielectric chip antenna structure according to the first embodiment of the present invention is mounted on a PCB composed of multiple layers. The PCB has a feeding line formed thereon in a predetermined pattern thereon for feeding. The PCB is composed of a top plane (TP) and a bottom plane (BP), which are short-circuited.

The top plane TP of the PCB includes a first metal conductor 1 for feeding, a second metal conductor 2 for fixing the antenna while short-circuiting the first metal conductor 1 and a feeding part of the antenna, and a third metal conductor 3 for fixing the antenna while short-circuiting a grounding part of the antenna. The top plane further includes a fourth metal conductor 4 formed at the longitudinal side of the antenna to induce antenna resonance characteristic through antenna coupling effect between the antenna and the ground, and a sixth metal conductor 8 for forming the fourth metal conductor 4 and controlling an input impedance of the antenna by adjusting the width thereof together with a seventh metal conductor 10 of the bottom plane.

The bottom plane of the PCB includes the seventh metal conductor 10 for forming the fourth metal conductor 4 and controlling the input impedance of the antenna by adjusting the width thereof together with the sixth metal conductor 8 of the top plane, an eight metal conductor 7, a ninth metal conductor 9, and a tenth metal conductor 11 for antenna feeding. The seventh metal conductor 10 and the second metal conductor 2 are short-circuited to fix the antenna.

Furthermore, the top plane TP and the bottom plane BP include circular or semicircular via holes 5 and 6 and a fifth metal conductor 12. The via holes 5 and 6 are formed in the top and bottom planes in such a manner as to penetrate the top and bottom planes to short-circuit them. The sidewalls of the via holes 5 and 6 are coated with a metal. The fifth metal conductor 12 short-circuits the top and bottom planes when the via hole 5 is not used Here, the via holes 5 and 6 can be divided into a first via hole 5 and a second via hole 6. The first via hole 5 and the fifth metal conductor 12 are selectively used. The second via hole 6 varies the radiation pattern of the antenna in response to a variation in the horizontal location of each via hole. A grounding metal conductor formed at one side of the seventh metal conductor 10 and a feeding metal conductor formed at the other side of the seventh metal conductor 10 can be used instead of the first via-hole 5, the seventh metal conductor 10 and the fifth metal conductor 12.

The fourth metal conductor 4 uses the fifth metal conductor 12 and is formed in an "L" form when the first via hole 5 is not used. The fourth metal conductor 4 is formed in a "ㄷ" form when the fifth metal conductor 12 is not used and the first via hole 5 is used and formed in a "-" form when the metal conductors 5, 11 and 12 are not used.

The first embodiment of the present invention efficiently reduces the resonance frequency through a gap between the long side of the antenna and the ground and improves a printed circuit board mounting technique. A second embodiment of the present invention designs the antenna such that the antenna is printed on the PCB, and third, fourth and fifth embodiments use the side of the antenna to induce resonance in multiple bands and improve antenna efficiency.

Figure 7:
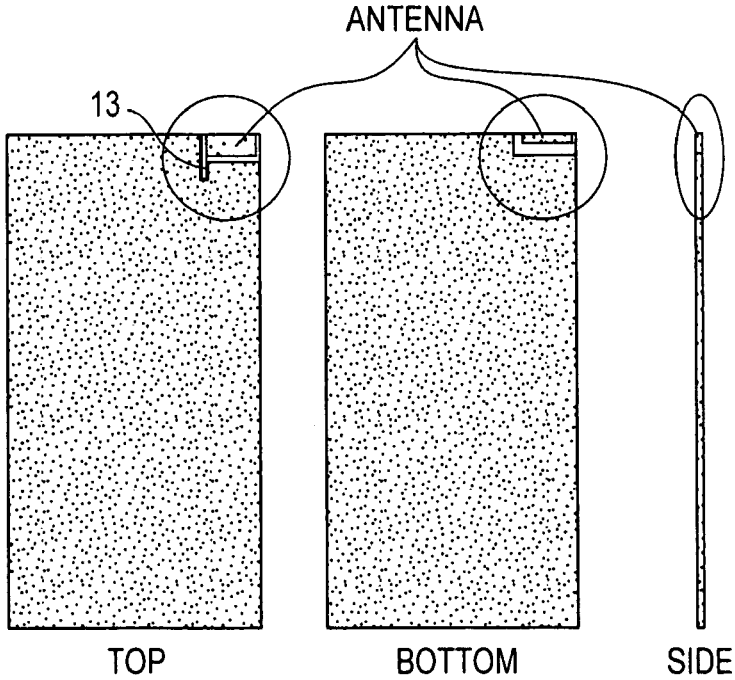
FIG. 7 illustrates the structure of a dielectric chip antenna structure according to a second embodiment of the present invention.
Figure 8:
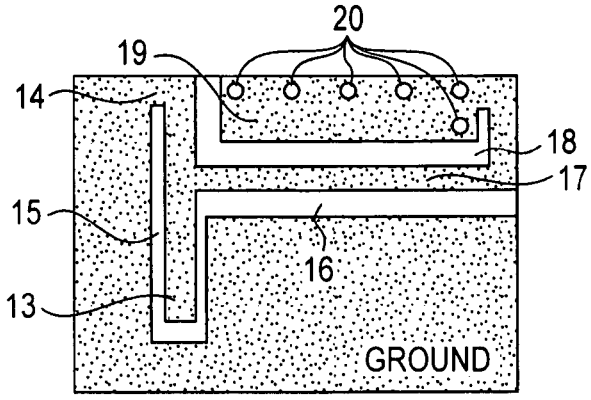
FIGS. 8 and 9 respectively illustrate a top plane and a bottom plane of the dielectric chip antenna structure according to the second embodiment of the present invention.
Figure 9:
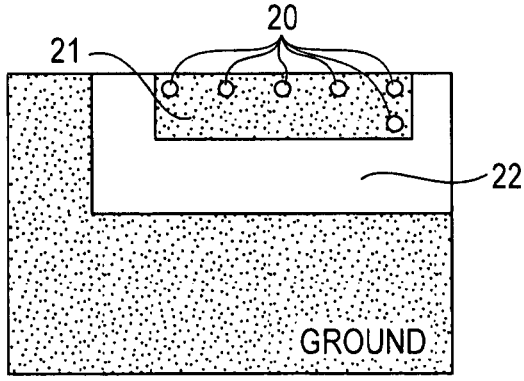

FIG. 7 illustrates the structure of a dielectric chip antenna structure according to the second embodiment of the present invention, and FIGS. 8 and 9 respectively illustrate top and bottom planes of the dielectric chip antenna structure according to the second embodiment of the present invention.

Referring to FIGS. 7, 8 and 9, the dielectric chip antenna structure according to the second embodiment of the present invention has the same structure as that of the dielectric chip antenna structure according to the first embodiment of the present invention, except that a metal conductor 13 short-circuited with a signal line directly provided by an RF module and a metal conductor 17 for antenna feeding are short-circuited to feed, and a metal conductor formed between the antenna and the ground reduces the antenna size and induces resonance characteristic. The metal conductor 17 carries out the same function as that of the fourth metal conductor 4 of the first embodiment of the present invention.

Figure 10:
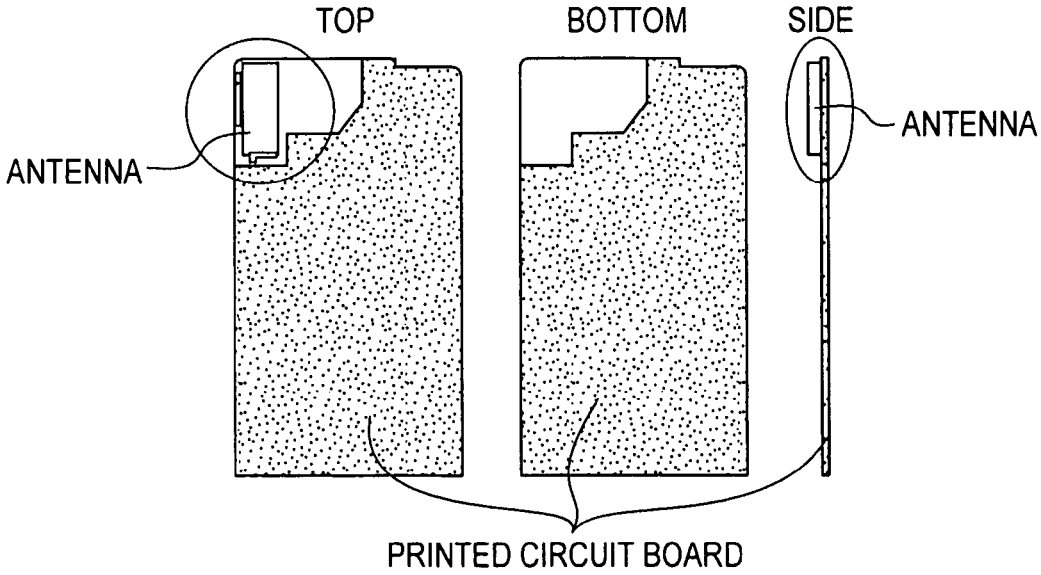
FIG. 10 illustrates the structure of a dielectric chip antenna structure according to third, fourth and fifth embodiments of the present invention.
Figure 11:
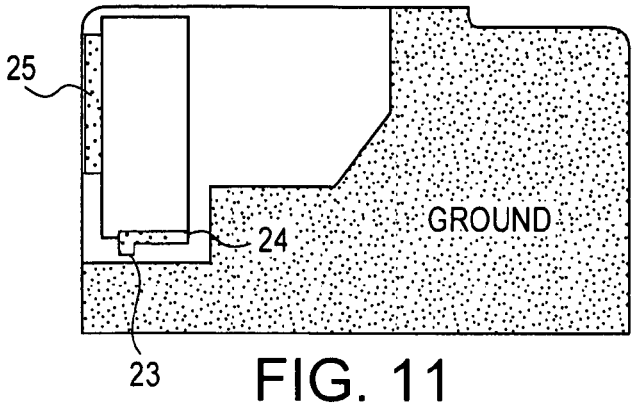
FIGS. 11 and 12 respectively illustrate top and bottom planes of the printed circuit board of the dielectric chip antenna structure according to the third, fourth and fifth embodiments of the present invention.
Figure 12:
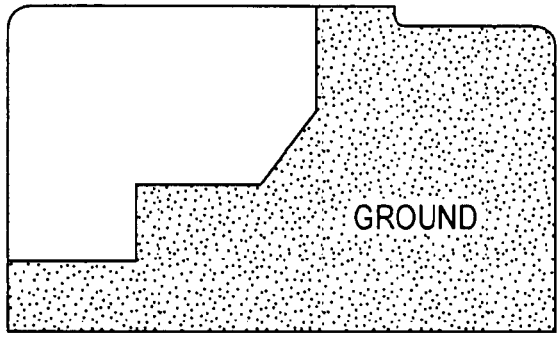
Figure 13:
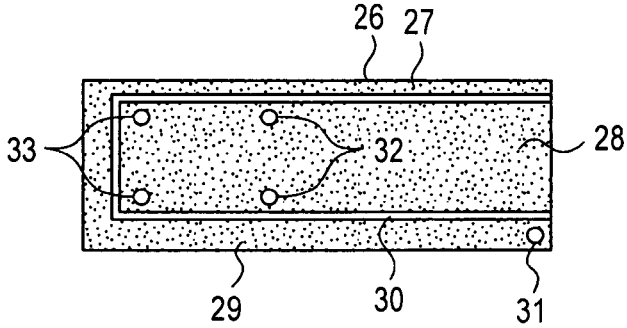
FIGS. 13 and 14 respectively illustrate top and bottom planes of the dielectric chip antenna structure according to the third embodiment of the present invention.
Figure 14:
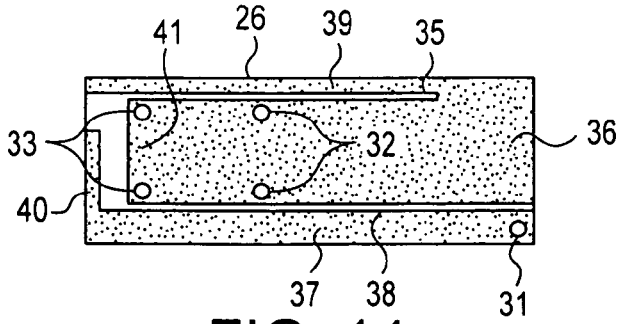
Figure 15:
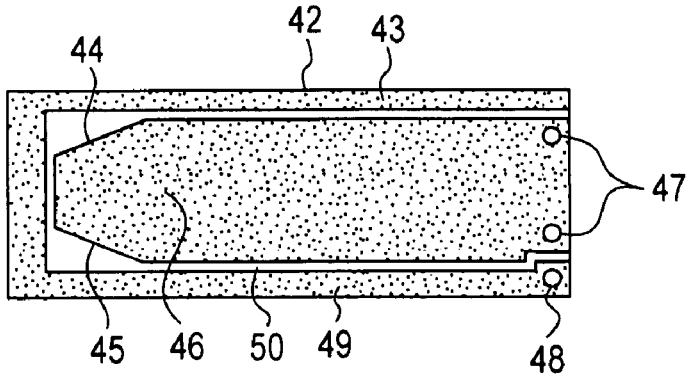
FIGS. 15 and 16 respectively illustrate top and bottom planes of the dielectric chip antenna structure according to the fourth embodiment of the present invention.
Figure 16:
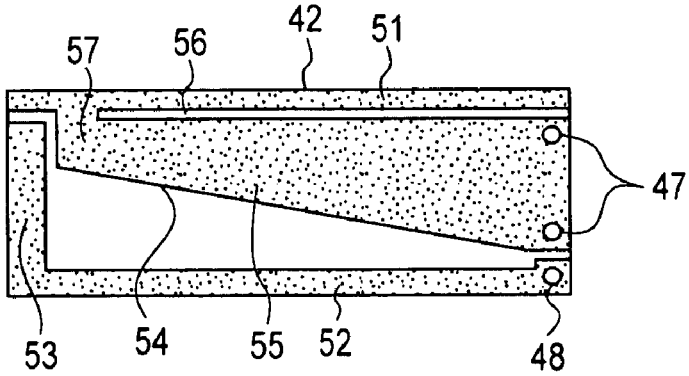
Figure 17:
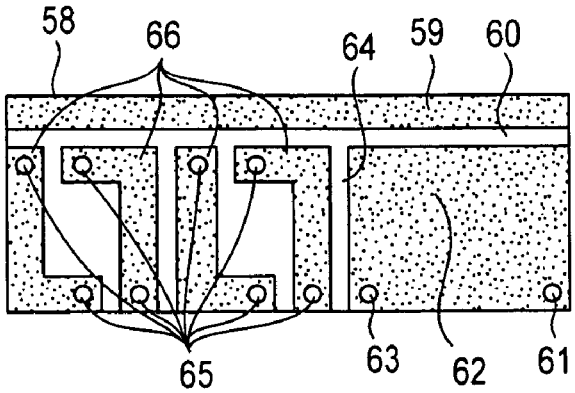
FIGS. 17 and 18 respectively illustrate top and bottom planes of the dielectric chip antenna structure according to the fifth embodiment of the present invention.
Figure 18:
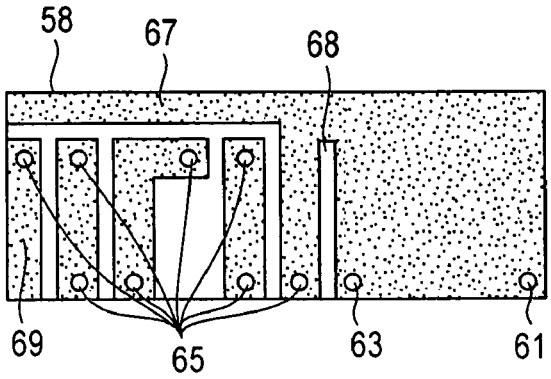

FIG. 10 illustrates the structure of a dielectric chip antenna structure according to third, fourth and fifth embodiments of the present invention, and FIGS. 11 and 12 respectively illustrate top and bottom planes of the PCB of the dielectric chip antenna structure according to the third, fourth and fifth embodiments of the present invention. In addition, FIGS. 13 and 14 respectively illustrate top and bottom planes of the dielectric chip antenna structure according to the third embodiment of the present invention, and FIGS. 15 and 16 respectively illustrate top and bottom planes of the dielectric chip antenna structure according to the fourth embodiment of the present invention. FIGS. 17 and 18 respectively illustrate top and bottom planes of the dielectric chip antenna structure according to the fifth embodiment of the present invention.

Referring to FIGS. 10 through 18, a metal conductor 23 and a metal conductor 24 short-circuited with a signal line, a metal conductor 40, a metal conductor 53, and a metal conductor 69 are short-circuited to feed in the third, fourth and fifth embodiments of the present invention.

While the dielectric chip antenna structure according to the third, fourth and fifth embodiments of the present invention modifies the theoretical feeding structure of a monopole antenna, a metal conductor 26, a metal conductor 42 and a metal conductor 58 are formed at the long side of the antenna to improve antenna radiation efficiency in terms of the structure of the antenna. Here, the dielectric chip antenna structure according to the third, fourth and fifth embodiments of the present invention has different metal conductor structures in response to antenna structures.

The operation of the dielectric chip antenna structures according to the embodiments of the present invention will now be explained.

First of all, the feeding structures of the dielectric chip antenna structures according to the first through fifth embodiments of the present invention are described. A CPW (Co-Planar Waveguide) or a microstrip line is formed on the PCB and the metal conductor short-circuited with the signal line directly provided by the RF module and the metal conductor for antenna feeding are short-circuited to feed.

While the theoretical feeding structure of a conventional reverse F type antenna is modified and used in the first and second embodiments and the theoretical feeding structure of a conventional monopole antenna is modified and used in the third, fourth and fifth embodiments, the dielectric chip antenna structures according to the first through fifth embodiments of the present invention can become smaller than the conventional antennas.

In general, the PCB of an antenna is composed of multiple layers, which are connected using circular or semicircular via holes. This PCB is used as the ground of the antenna and composed of top and bottom planes, which are short-circuited.

In the embodiments of the present invention, metal conductors on the top plane of the PCB on which the antenna is mounted are removed, antenna resonance characteristic is enhanced by electrical effect of the gap between the antenna and the ground, the space occupied by the antenna is reduced, and convenience of mounting the antenna using metal conductors on the PCB is improved.

The first embodiment of the present invention uses the fourth metal conductor 4 formed at the long side of the antenna, distinguished from a conventional built-in antenna, to induce antenna resonance characteristic through coupling between the ground and the antenna and minimizes the space occupied by the antenna to miniaturize the antenna.

In the second embodiment of the present invention, the metal conductor 17 carries out the same function as that of the fourth metal conductor 4 of the first embodiment. The third, fourth and fifth embodiments of the present invention enhance antenna radiation efficiency using metal conductors 26, 42 and 58 formed at the lateral side of the antenna along the longitudinal direction of the antenna.

In the first through fifth embodiments of the present invention, the via holes 5 and 6 penetrate the top or bottom faces of the antenna in a circular or semicircular form for the purpose of applying the antenna to mobile communication services. The sidewalls of the circular or semicircular via holes are coated with a metal to short-circuit the top and bottom planes.

While the via holes 5 and 6 are formed in a circular or semicircular shape when the antenna is designed in a rectangular solid form, a metal conductor can replace the via holes when the top plane and an in-between plane are formed of air layers.

The aforementioned antenna can be modified in various structures to meet user's environments and provide mobile communication services suitable for user's various demands. Furthermore, the antenna structure according to the present invention minimizes the space occupied by the antenna such that the antenna becomes smaller than the general built-in antenna. Thus, the antenna according to the present invention can be applied to a variety of products.

In the case of built-in antenna, resonance frequency frequently does not meet a desired tuning point due to a deviation between design and manufacturing processes. Accordingly, the antenna of the present invention has multiple tuning points to smoothly carry out an operation for tuning the resonance frequency to a desired frequency. Furthermore, the metal conductors designed on the PCB have tuning points so that the antenna can be miniaturized and resonance characteristic can be improved while fully using the PCB.

As described above, the dielectric chip antenna structure according to the present invention has various tuning points such that the antenna can be selectively used in a desired frequency. Furthermore, the dielectric chip antenna structure has improved performance in the resonance band and an omni-directional radiation pattern.

Figure 19:
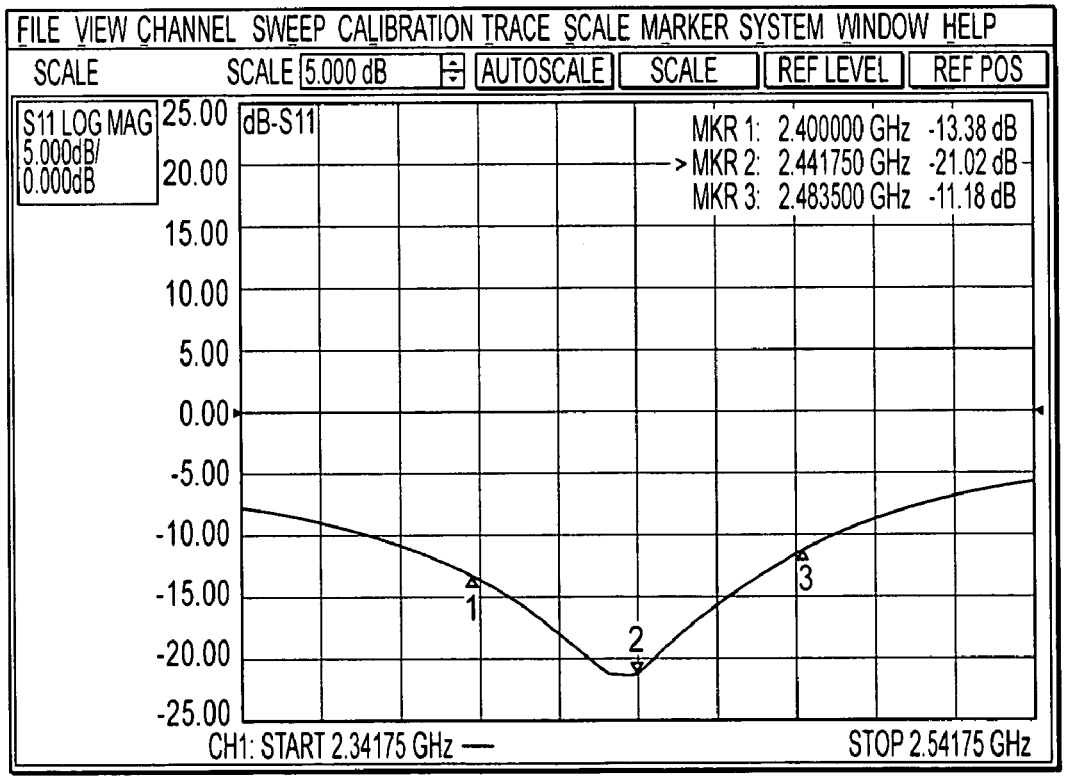
FIG. 19 shows the characteristic of the dielectric chip antenna structure according to the first embodiment of the present invention, measured using Agilent E8357A (300 KHz to 6 GHz) PNA series network analyzer.

FIG. 19 shows characteristic of the dielectric chip antenna structure according to the first embodiment of the present invention, measured using Agilent E8357A (300 KHz to 6 GHz) PNA series network analyzer.

Referring to FIG. 1, the first metal conductor 1 has a resistance of 50 Ohm. The second metal conductor 2, short-circuit with the first metal conductor 1, is short-circuited with the seventh metal conductor 10 such that the antenna radiates maximum electromagnetic energy to the air at an appropriate resonance frequency. In addition, the second metal conductor 2 fixes the antenna when the antenna is mounted on the PCB.

The third metal conductor 3 is short-circuited with the tenth metal conductor 11 to ground the antenna. The structure of the antenna can be divided into two in response to whether the third metal conductor 3 exists or not. That is, the antenna has a monopole type feeding structure when the third metal conductor 3 is not formed on the PCB. When the third metal conductor 3 exists, the antenna has a reverse F type feeding structure because there is a single dipole in a dipole antenna.

The longitudinal distance of the third metal conductor 3 and first metal conductor 1 serves as Balun of the dipole antenna. The area of the third metal conductor 3 can be adjusted while varying the area of the third metal conductor 3 toward the first metal conductor 1 for optimized antenna resonance. The third metal conductor 3 fixes the antenna when the antenna is mounted on the PCB as does the second metal conductor 2.

The fourth metal conductor 4 is formed at the long side of the antenna. The fourth metal conductor 4 is designed by a method different from a conventional method of increasing the electrical length of the antenna using a meander line to reduce the resonance frequency and miniaturize the antenna in the convention built-in antenna. That is, while the dielectric chip antenna structure according to the first embodiment of the present invention uses the method of controlling the electrical length of the antenna using a meander line, the dielectric chip antenna structure of the invention fully uses antenna coupling effect caused by a voltage generated between the gap between the fourth metal conductor 4 and the metal conductor formed on the PCB and reduces the space occupied by the antenna and the size of the antenna, distinguished from the conventional antenna using a meander line.

It can be estimated that antenna resonance occurs at a low frequency when the fourth metal conductor 4 approaches the ground and thus the size of the antenna can be reduced owing to low resonance frequency. When the fourth metal conductor 4 becomes distant from the ground, antenna resonance occurs at a high frequency.

The sixth metal conductor 8 and the seventh metal conductor 10 are required for forming the fourth metal conductor 4 when the antenna is a dielectric having a rectangular form. The input impedance of the antenna can be controlled by adjusting the width of the sixth and seventh metal conductors 8 and 10. When the antenna is formed of an air layer, the sixth and ninth metal conductors 8 and 10 can be eliminated. Furthermore, the seventh metal conductor 10 is short-circuited with the second metal conductor 2 formed in the top plane of the PCB to fix the antenna.

The first via hole 5 is a metal conductor used when the fifth metal conductor 12 is not formed on the PCB and short-circuits the top and bottom planes. When the fifth metal conductor 12 exists, the first via hole 5 is selectively used. In this case, the first via hole 5 does not have a large effect on the resonance characteristic of the antenna.

When the metal conductors 5, 11 and 12 are eliminated and a grounding metal conductor formed on one side of the metal conductor 10 and a feeding metal conductor formed on the other side of the metal conductor 10 are used, the metal conductor structure has a "-" form. When the first via hole 5 is eliminated and the fifth metal conductor 12 is used, the fourth metal conductor 4 has an "L" shape.

The second via hole 6 short-circuits the top and bottom planes and increases the electrical length of the antenna to reduce the size of the antenna. Furthermore, the radiation pattern of the antenna varies with a variation in the position of the second via hole 6.

Figure 20:
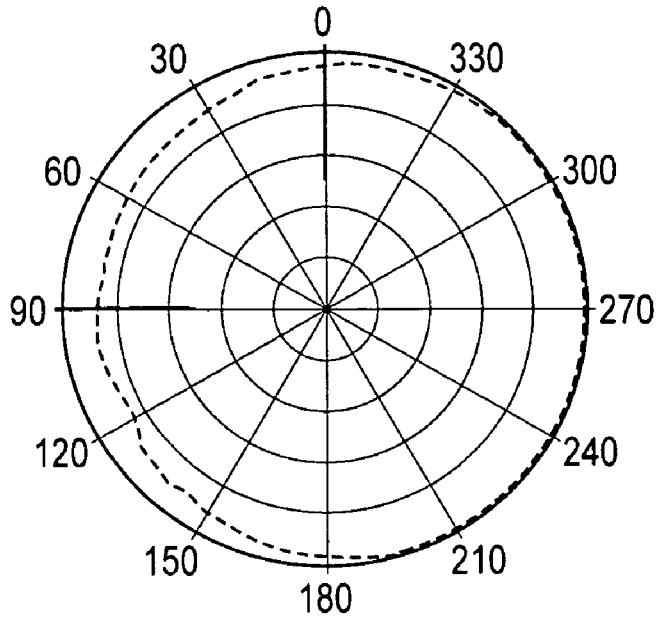
FIGS. 20 and 21 show radiation pattern characteristics of the dielectric chip antenna structure according to the first embodiment of the present invention.
Figure 21:
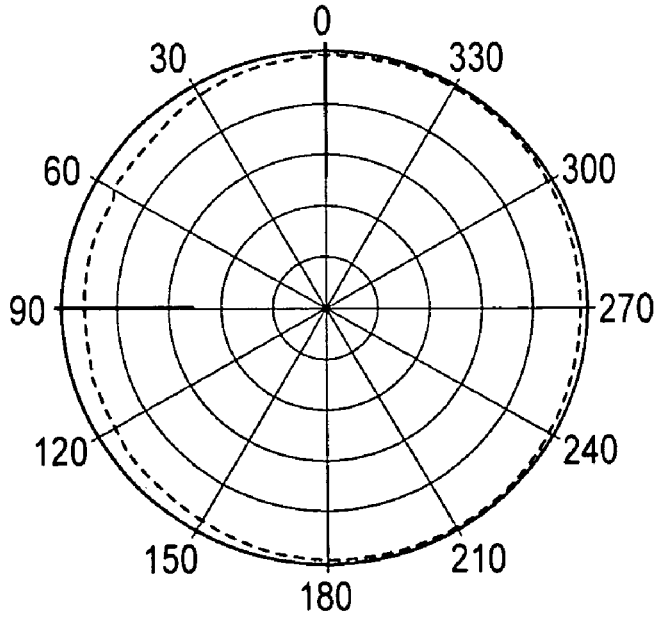

FIGS. 20 and 21 show radiation pattern characteristics of the dielectric chip antenna structure according to the first embodiment of the present invention.

Figure 5:
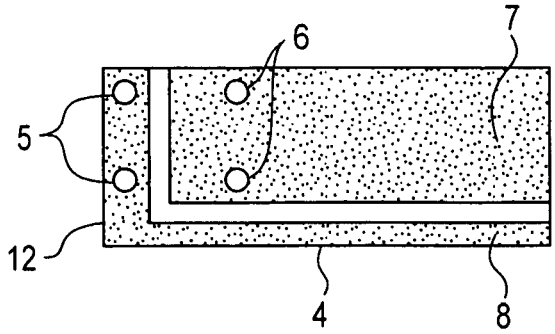
FIGS. 5 and 6 respectively illustrate a top plane and a bottom plane of the dielectric chip antenna structure according to the first embodiment of the present invention.
Figure 6:
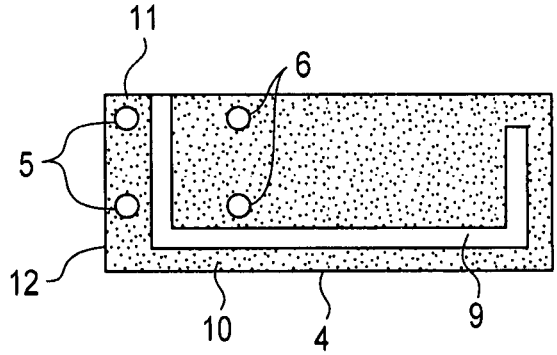

FIGS. 5 and 6 illustrate cases where two antennas are used on a single PCB. In this case, the antenna radiation pattern slants to one side, as shown in FIG. 20, and interference between the antennas is reduced. When the second via hole 6 is inclined to the right of the antenna, that is, the direction opposite to the first via hole 5, the antenna radiation pattern has a general dipole form, as shown in FIG. 23.

In the second embodiment, the grounding metal conductor 14 can be short-circuited to one side of the metal conductor 17.

Figure 22:
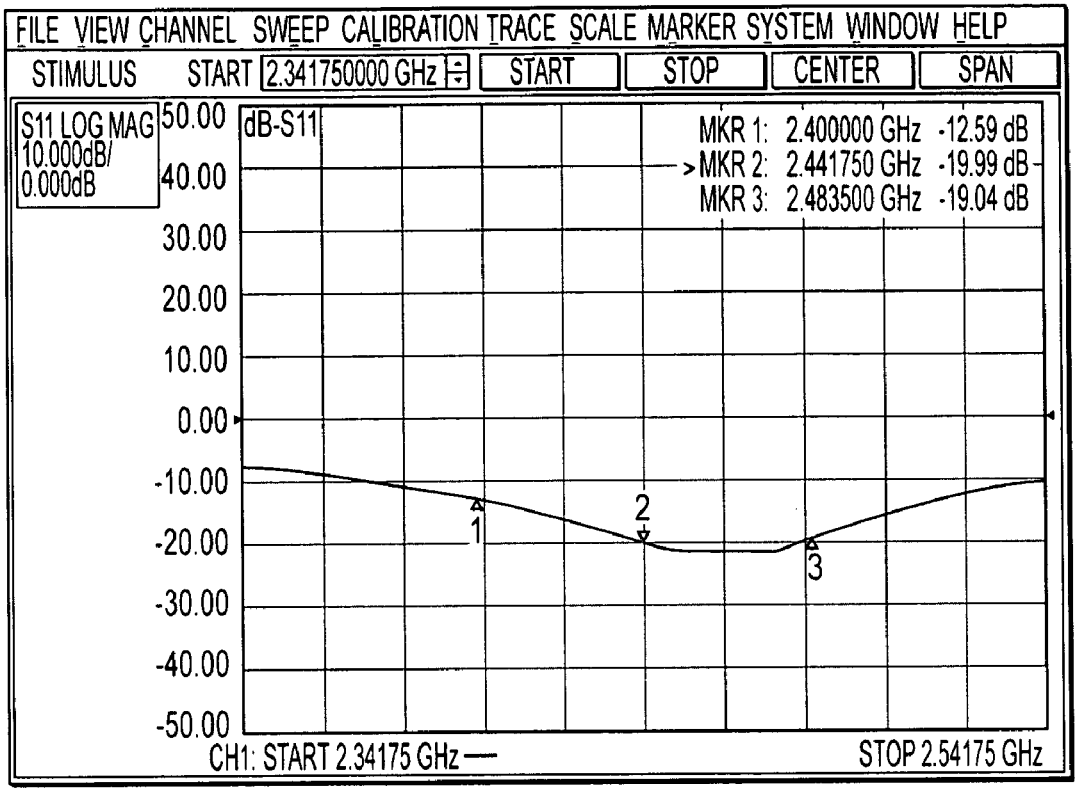
FIG. 22 shows return loss characteristic of the dielectric chip antenna structure according to the second embodiment of the present invention, measured using Agilent E8357A (300 KHz to 6 GHz) PNA series network analyzer.
Figure 23:
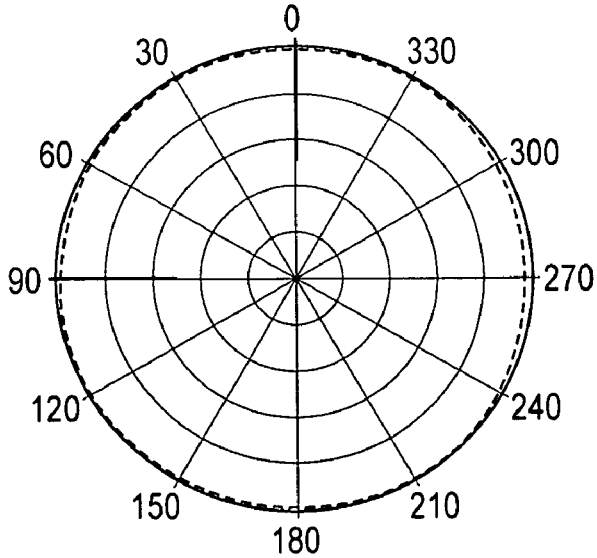
FIG. 23 shows radiation pattern characteristic of the dielectric chip antenna structure according to the second embodiment of the present invention.

FIG. 22 shows return loss characteristic of the dielectric chip antenna structure according to the second embodiment of the present invention, measured using Agilent E8357A (300 KHz to 6 GHz) PNA series network analyzer, and FIG. 23 shows radiation pattern characteristic of the dielectric chip antenna structure according to the second embodiment of the present invention.

The dielectric chip antenna structure according to the second embodiment of the present invention is obtained by modifying the dielectric chip antenna structure of the first embodiment of the present invention and it is printed on the PCB.

That is, the metal conductor 13 is identical to the first metal conductor 1 of the first embodiment and the metal conductor 14 corresponds to the third metal conductor 3 of the first embodiment. In addition, the metal conductor 17 is identical to the fourth metal conductor 4. However, the dielectric chip antenna structure of the second embodiment has no metal conductor formed at the lateral side of the antenna and the metal conductor 17 replaces the metal conductor at the lateral side of the antenna. Thus, the volume of the antenna is reduced and thus the antenna radiation characteristic has a shade region larger than that of the dielectric chip antenna structure according to the first embodiment. To minimize the shade region of the radiation characteristic, the dielectric chip antenna structure of the second embodiment uses cylindrical metal conductors 20 for short-circuiting a metal conductor 19 and a bottom metal conductor 21.

The dielectric chip antenna structure of the second embodiment generates resonance even when the metal conductors 20 and 21 are eliminated. Furthermore, there is no variation in the antenna characteristic when the metal conductor formed at the lateral side of the antenna is used instead of the metal conductor 20. It is preferable to selectively remove the metal conductor 20 in order to reduce the space occupied by the antenna and increase the electrical length of the antenna.

Figure 24:
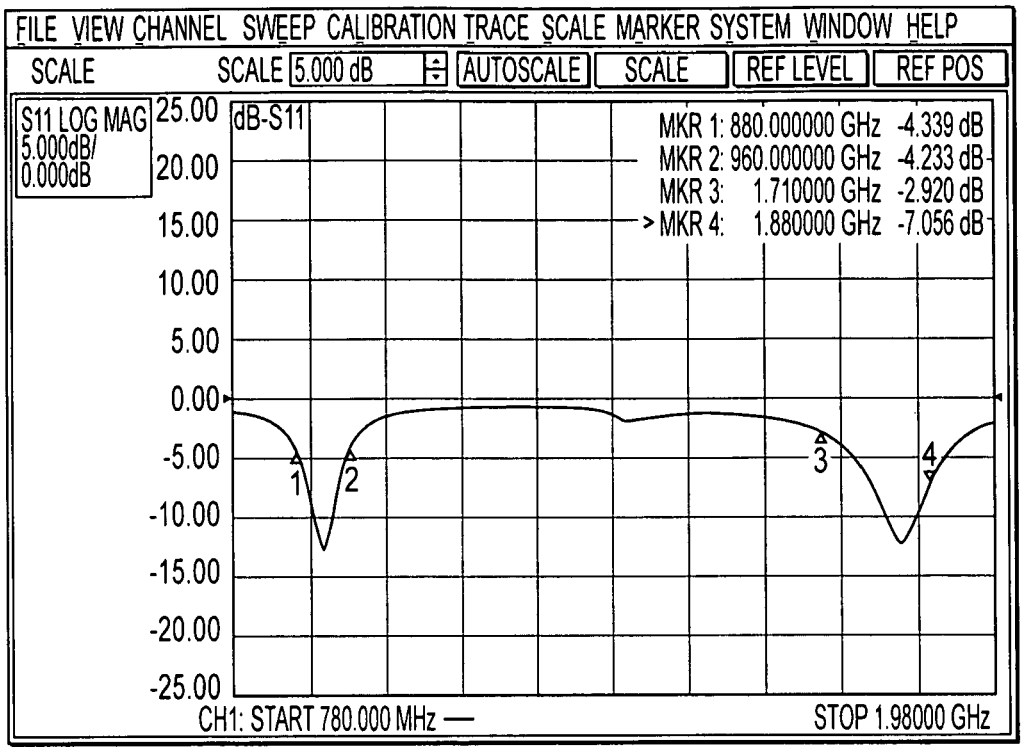
FIG. 24 shows return loss characteristic of the dielectric chip antenna structure according to the third embodiment of the present invention, measured using Agilent E8357A (300 KHz to 6 GHz) PNA series network analyzer.

FIG. 24 shows return loss characteristic of the dielectric chip antenna structure according to the third embodiment of the present invention, measured using Agilent E8357A (300 KHz to 6 GHz) PNA series network analyzer.

Referring to FIGS. 11 and 24, a metal pattern 23 of the dielectric chip antenna structure according to the third embodiment of the invention is a metal conductor short-circuited with a signal line directly provided from an RF module and has a resistance of 50 Ohm. The dielectric chip antenna structure of the third embodiment of the invention can variably use matching for antenna resonance characteristic between the signal line and the metal conductor 23.

A metal conductor 24 short-circuited with the metal conductor 23 is short-circuited with a bottom metal conductor 40 such that the antenna radiates maximum electromagnetic energy to the air at an appropriate resonance frequency. Furthermore, the metal conductor 24 fixes the antenna when the antenna is mounted on the PCB. A metal conductor 25 is short-circuited with a bottom metal conductor 37. The metal conductor 25 is designed for the purpose of fixing the antenna and increasing the electrical length of the antenna. The metal conductor 25 can be eliminated.

The electrical flow of the dielectric chip antenna structure according to the third embodiment of the invention passes through the signal line directly provided by the RF module and the metal conductor 23 to reach the metal conductor 24. Then, the electrical flow is short-circuited with the bottom metal conductor 37 and passes through a circular via hole 31. Subsequently, it is short-circuited with the top metal conductor 29, and then short-circuited with a bottom metal conductor 36 through a metal conductor 26 placed at the long side of the antenna. The bottom metal conductor 36 is short-circuited with a top metal conductor 28 using metal conductors 32 and 33.

The dielectric chip antenna structure of the third embodiment of the invention is a modified one of the monopole antenna and it is designed along the aforementioned electrical flow to increase the electrical length of the antenna. Furthermore, the dielectric chip antenna structure of the third embodiment of the invention uses the metal conductor 26 located at the long side of the antenna in order to increase antenna radiation efficiency.

Figure 25:
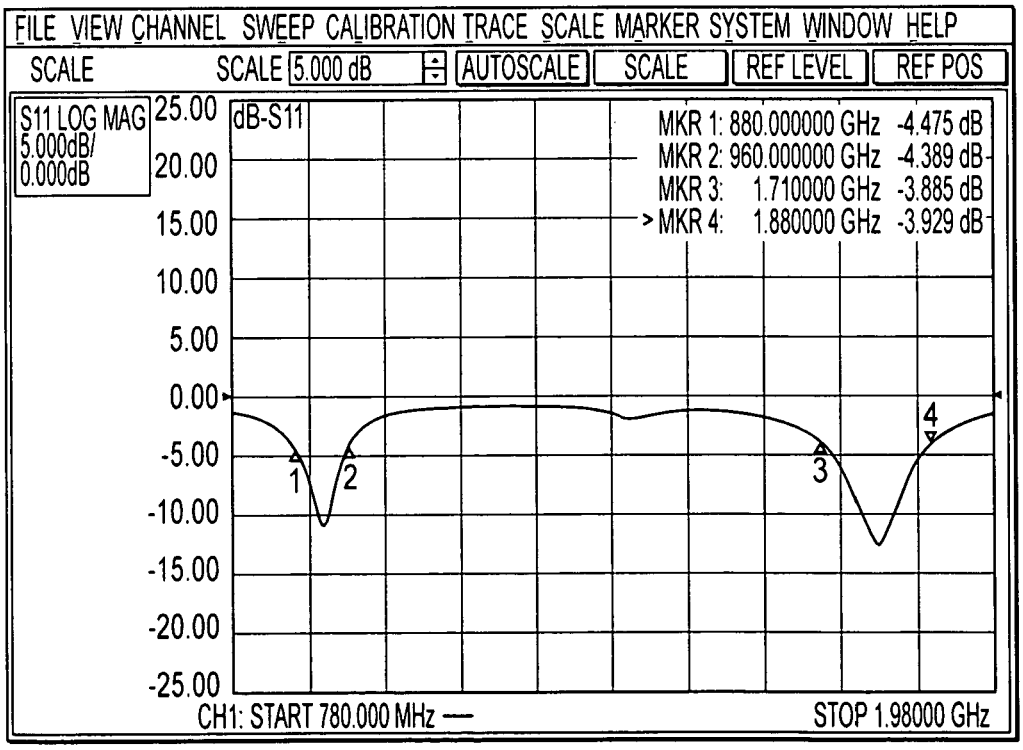
FIG. 25 shows return loss characteristic of the dielectric chip antenna structure according to the fourth embodiment of the present invention, measured using Agilent E8357A (300 KHz to 6 GHz) PNA series network analyzer.
Figure 26:
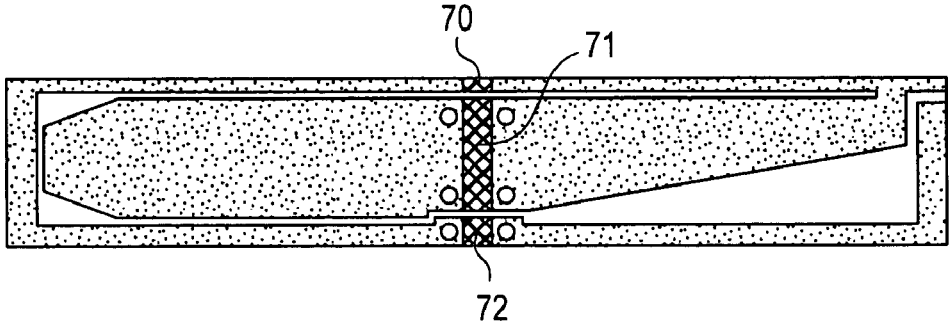
FIG. 26 shows radiation pattern characteristic of the dielectric chip antenna structure according to the fourth embodiment of the present invention.

FIG. 25 shows return loss characteristic of the dielectric chip antenna structure according to the fourth embodiment of the present invention, measured using Agilent E8357A (300 KHz to 6 GHz) PNA series network analyzer, and FIG. 26 shows radiation pattern characteristic of the dielectric chip antenna structure according to the fourth embodiment of the present invention.

Referring to FIGS. 25 and 26, the dielectric chip antenna structure according to the fourth embodiment of the present invention folds the antenna pattern to miniaturize a folded slit patch structure and uses a metal conductor 42 formed at the horizontal side of the antenna to improve antenna radiation characteristic.

Furthermore, the dielectric chip antenna structure of the fourth embodiment forms metal conductors 44, 45 and 54 in a diagonal form to induce resonance while maintaining antenna radiation efficiency. When the metal conductors 44, 45 and 54 are not designed in a diagonal form but in a right-angled form, the dielectric chip antenna structure of the fourth embodiment of the invention generates resonance at a frequency lower than the frequency at which the dielectric chip antenna structure having the metal conductors 44, 45 and 54 designed in a diagonal pattern generates resonance. Thus, the antenna can be further miniaturized.

Figure 27:
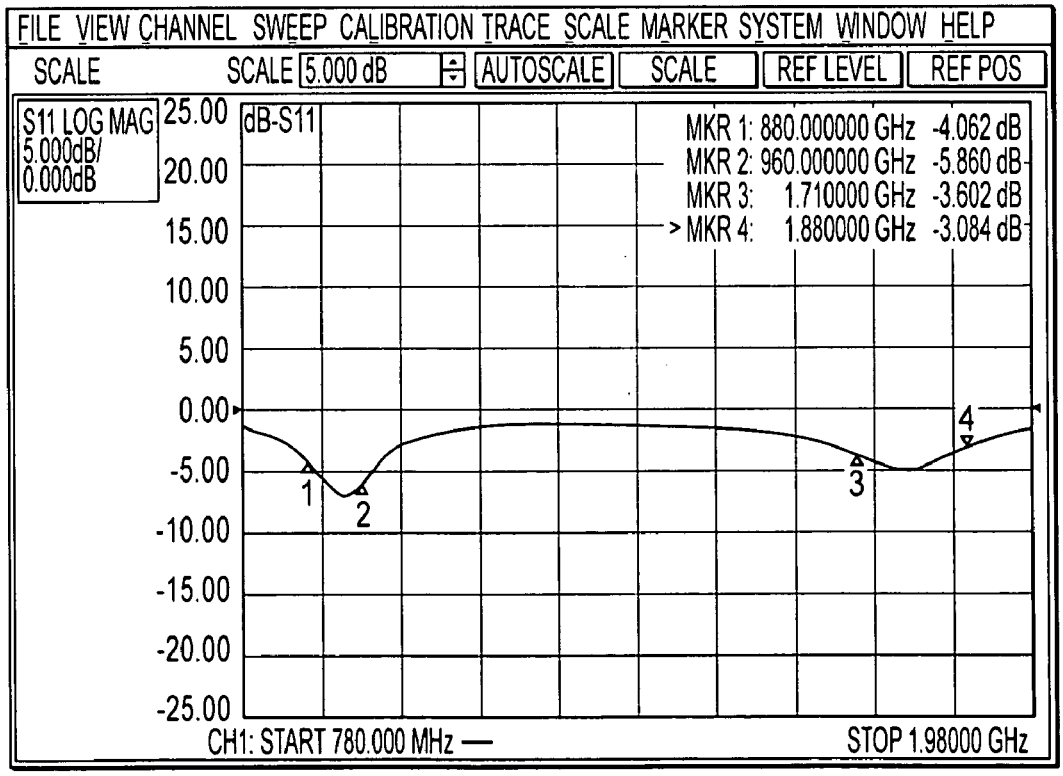
FIG. 27 shows return loss characteristic of the dielectric chip antenna structure according to the fifth embodiment of the present invention, measured using Agilent E8357A (300 KHz to 6 GHz) PNA series network analyzer.

FIG. 27 shows return loss characteristic of the dielectric chip antenna structure according to the fifth embodiment of the present invention, measured using Agilent E8357A (300 KHz to 6 GHz) PNA series network analyzer. Referring to FIG. 27, the dielectric chip antenna structure according to the fifth embodiment of the present invention has a helical form fabricated by cylindrically winding a metal conductor line to miniaturize a monopole.

A signal transmitted from an RF module through a metal conductor 69 passes through metal conductors 65 and 66 is connected to an antenna radiation part. The signal is radiated by a metal conductor having a wide area at the antenna radiation part and a side metal conductor 58 formed at the long side of the antenna.

In the first through fifth embodiments of the present invention, the metal conductors 10, 40, 53 and 69 are short-circuited such that the antenna radiates maximum electromagnetic energy to the air at an appropriate frequency and fix the antenna when the antenna is mounted on the PCB.

The dielectric chip antenna structure shown in FIGS. 17 and 18 uses a rectangular dielectric. When the antenna is composed of an air layer, the helical structure can replace metal conductors 65 and 66.

The dielectric chip antenna structure according to the present invention can reduce the space required for the antenna in consideration of magnetic field formed between metal conductors on the PCB and the antenna. Furthermore, when antennas having the same wavelength are formed on a single PCB, the dielectric chip antenna structure of the invention can minimize deterioration of radiation characteristic due to phase interference between the antennas using circular or semicircular via holes.

The dielectric chip antenna structure according to the present invention has various tuning points and thus it can be selectively used in a desired frequency band. Moreover, the dielectric chip antenna structure has good performance in a resonance band and an omni-directional radiation pattern. The dielectric chip antenna structure of the present invention can be applied to various products because it is miniaturized to be used for mobile communication services.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A dielectric chip antenna structure, comprising:

a printed circuit board on which an antenna is mounted, the printed circuit board having a feeding line formed in a predetermined pattern thereon for feeding and top and bottom planes which are short-circuited;

a first metal conductor formed on the top plane of the printed circuit board, for feeding;

a second metal conductor for short-circuiting the first metal conductor and a feeding part of the antenna and fixing the antenna;

a third metal conductor for short-circuiting a grounding part of the antenna and fixing the antenna;

a fourth metal conductor formed at the lateral side of the antenna along the longitudinal direction of the antenna to induce antenna resonance characteristic through antenna coupling effect between the antenna and the ground;

circular or semicircular via holes formed in the top and bottom planes in such a manner as to penetrate the top and bottom planes to short-circuit the top and bottom planes, the sidewalls of the via holes being coated with a metal;

a fifth metal conductor for connecting the top and bottom planes when the via holes are eliminated; and sixth and seventh metal conductors respectively formed on the top and bottom planes for forming the fourth metal conductor and control an input impedance of the antenna.

2. The dielectric chip antenna structure as claimed in claim 1, wherein the via holes include a first via hole for short-circuiting the top and bottom planes and replacing the fifth metal conductor, and a second via hole for varying a radiation pattern of the antenna in response to a variation in the horizontal location of each via hole.

3. The dielectric chip antenna structure as claimed in claim 2, wherein the fourth metal conductor is formed in an "L" shape when the fifth metal conductor is used and the first via hole is eliminated, formed in a "⊏" shape when the fifth metal conductor is eliminated and the first via hole is used, and formed in a "-" shape when the fifth metal conductor and the first via hole are eliminated.

4. The dielectric chip antenna structure as claimed in claim 1, wherein the metal conductors formed on the printed circuit board has at least one tuning point such that the antenna can be selectively used in a desired frequency band.

5. The dielectric chip antenna structure as claimed in claim 1, wherein the size of the third metal conductor is controlled while varying its area toward the first metal conductor to optimize resonance of the antenna.

6. The dielectric chip antenna structure as claimed in claim 1, wherein antenna resonance occurs at a low frequency as the fourth metal conductor approaches the ground, but occurs at a high frequency as the fourth metal conductor becomes distant from the ground.

7. The dielectric chip antenna structure as claimed in claim 1, wherein, when the first and fourth metal conductors are printed on the printed circuit board, a metal conductor having a "¬" form is short-circuited to the end of a feeding line having a "⌋" form, which is connected to the first and fourth metal conductors.

8. The dielectric chip antenna structure as claimed in claim 7, wherein the via holes for short-circuiting the top and bottom planes are selectively used or eliminated.

9. The dielectric chip antenna structure as claimed in claim 7, wherein the first metal conductor variably uses circuit matching between the first metal and a signal line directly provided by an RF module of the antenna for antenna resonance characteristic.

10. The dielectric chip antenna structure as claimed in claim 7, wherein the distance between the via holes is controlled such that the via holes function as a metal conductor inside the antenna.

11. The dielectric chip antenna structure as claimed in claim 1, wherein the second metal conductor is short-circuited with the seventh metal conductor such that the antenna radiates maximum electromagnetic energy to the air at an appropriate resonance frequency and fixes the antenna when the antenna is mounted on the printed circuit board.

12. The dielectric chip antenna structure as claimed in claim 1, wherein the fourth metal conductor is applied to an antenna having a folded slit patch structure to improve antenna radiation characteristic.

13. The dielectric chip antenna structure as claimed in claim 12, wherein the top and bottom planes forms a diagonal pattern such that they are applied to an antenna for inducing resonance in multiple bands to induce antenna resonance at an appropriate point while maintaining antenna radiation efficiency.

14. The dielectric chip antenna structure as claimed in claim 1, wherein the dielectric chip antenna structure is applied to a helical antenna, fabricated by cylindrically winding a metal line to miniaturize a monople, the top and bottom planes use a meander line through which a signal transmitted from the RF module of the antenna through the first metal conductor is connected to the terminal part where the antenna radiates through the via holes, and the antenna radiates electromagnetic energy according to a metal conductor formed at the terminal part and the fourth metal conductor.

15. The dielectric chip antenna structure as claimed in claim 14, wherein the dielectric chip antenna structure uses a rectangular dielectric and, and when the antenna is composed of an air layer, the dielectric chip antenna structure uses a helical structure instead of the via holes.

* * * * *

UNITED STATES PATENT AND TRADEMARK OFFICE

CERTIFICATE OF CORRECTION

PATENT NO. : 7,170,456 B2
APPLICATION NO. : 11/194703
DATED : January 30, 2007
INVENTOR(S) : W. I. Kwak et al.

It is certified that error appears in the above-identified patent and that said Letters Patent is hereby corrected as shown below:

Column 12, line 14 (claim 15, line 3) of the printed patent, delete "and" (second occurrence).

Signed and Sealed this

First Day of April, 2008

JON W. DUDAS
*Director of the United States Patent and Trademark Office*